United States Patent [19]

Skinner

[11] 4,427,063

[45] Jan. 24, 1984

[54] RETRIEVABLE BRIDGE PLUG

[75] Inventor: Neal G. Skinner, Duncan, Okla.

[73] Assignee: Halliburton Company, Duncan, Okla.

[21] Appl. No.: 319,384

[22] Filed: Nov. 9, 1981

[51] Int. Cl.[3] ..... E21B 33/134

[52] U.S. Cl. ..... 166/134; 166/137; 166/139; 166/237

[58] Field of Search ..... 166/119, 123, 131, 133, 166/134, 135, 136, 137, 138, 139, 212, 210, 214, 211, 216, 217, 237, 140, 240

[56] References Cited

U.S. PATENT DOCUMENTS

| | | | |
|---|---|---|---|
| 3,011,558 | 12/1961 | Conrad | 166/212 |
| 3,142,338 | 7/1964 | Brown | 166/134 |
| 3,282,342 | 11/1966 | Mott | 166/134 |
| 3,289,766 | 12/1966 | Bigelow | 166/139 |
| 3,364,997 | 1/1968 | Current | 166/134 |
| 3,419,079 | 12/1968 | Current | 166/206 |
| 3,422,900 | 1/1969 | Hyde et al. | 166/134 |
| 3,456,723 | 7/1969 | Current et al. | 166/120 |
| 3,470,951 | 10/1969 | McGill | 166/237 |
| 3,495,659 | 2/1970 | McGill | 166/125 |
| 3,502,144 | 3/1970 | Young | 166/216 |
| 3,508,610 | 4/1970 | Kisling | 166/135 |
| 4,156,460 | 5/1979 | Crowe | 166/120 |

FOREIGN PATENT DOCUMENTS

| | | | |
|---|---|---|---|
| 681782 | 10/1952 | United Kingdom | 166/140 |

OTHER PUBLICATIONS

Baker "Universal Type" Packer, Dec. 1950 Petroleum Engineers.

*Primary Examiner*—Stephen J. Novosad
*Assistant Examiner*—William P. Neuder
*Attorney, Agent, or Firm*—Alan T. McCollom; James R. Duzan; Thomas R. Weaver

[57] ABSTRACT

A retrievable bridge plug of the type having upper and lower anchors and an elastomeric packer for sealing a well casing. Drill string manipulation of the plug body effects packer compression and sealing. A ratchet maintains packer compression when engaged and permits packer expansion when disengaged. A cam surface on the plug body engages and disengages the ratchet responsive to longitudinal movement of the plug body.

6 Claims, 8 Drawing Figures

RETRIEVABLE BRIDGE PLUG

BACKGROUND AND SUMMARY OF THE INVENTION

This invention relates to retrievable bridge plugs for use in sealing a casing in a well, and more particularly to such plugs of the type using an elastomeric packer to effect sealing.

The bridge plug of the present invention is of the type having upper and lower anchors with the elastomeric packer positioned about a mandrel therebetween. Drill string manipulation is used to set the anchors and compress the packer thus sealing the casing at a selected location.

Such plugs, when so set, can be subject to large hydraulic pressures from either below or above the plug. Even slight slippage of the anchors against the well casing can cause a reduction of the packer-compressing force and the seal formed by the packer may be lost.

In the past, plugs have been provided with means for maintaining packer-compression force independent of that provided by the anchors. Such past plugs include ratchet mechanisms which are actuated by drill string manipulation and when so actuated, maintain the packer in a compressed condition.

One such past ratchet mechanism is formed on facing radially inward and outward surfaces. Each ratchet surface is helically formed, in the manner of a screw thread. Disengaging the ratchet mechanism requires rotation of the drill string to unscrew it. Such rotation requires a tremendous amount of torque in view of the force required to properly set the packer. Another past mechanism uses a ratchet to maintain packer compression and a system of shear pins and retaining rings to relieve packer-deforming pressure as well as release the anchors. This permits only one setting of the plug, since if it is desired to reset the plug, it must be withdrawn and the rings reset with new shear pins.

It is an object of the present invention to provide a retrievable bridge plug which overcomes the above-mentioned problems which exist in past plugs.

It is a more specific object of the invention to provide a retrievable bridge plug in which an elastomeric packer can be set or released in response to longitudinal movement of the plug body.

The instant embodiment of the invention includes a center mandrel having a packer mandrel concentrically mounted thereover. A packer carried about the packer mandrel, is compressed responsive to downward movement of the packer mandrel. Cooperating ratchet surfaces are provided about a portion of the packer mandrel and on the radially inward faces of collar segments which are fixedly disposed about the mandrel. A tang on the radial inward face of each collar segment extends through a longitudinal slot in the packer mandrel and contacts the center mandrel. The collar segments are all radially biased inwardly and each tang abuts against the center mandrel. A cam surface on the center mandrel causes radial inward and outward movement of the segments, dependent upon longitudinal center mandrel position, thus engaging and disengaging the ratchet surfaces. When engaged, the ratchet action between the two surfaces permits movement of the packer mandrel only in a packer-compressing direction.

These and other attendant objects and advantages of the invention will become more apparent in view of the drawings and following detailed description of the invention.

DETAILED DESCRIPTION OF A PREFERRED EMBODIMENT OF THE INVENTION

Figure 1A:
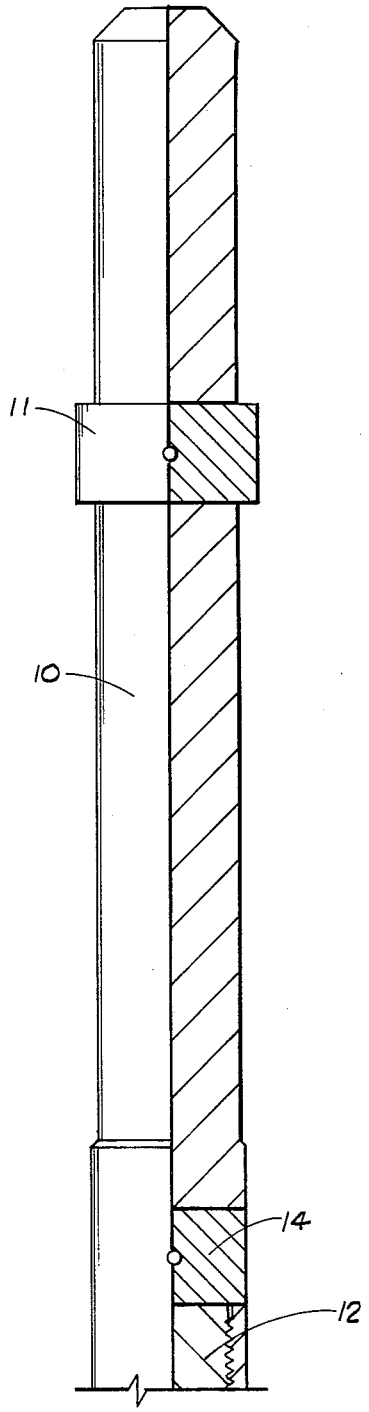
FIGS. 1*a*, 1 *b*, 1*c* and together, constitute a longitudinal quarter section of a preferred embodiment of the retrievable bridge plug of the present invention (with FIG. 1*c* being partially in half section), FIGS. 1*b*–1*d* being successive downward continuations of FIG. 1*a*.

Referring now to the drawings, and particularly to FIGS. 1*a*–1*d*, a conventional retrieving head 10 is provided at the top of a preferred embodiment of the retrievable bridge plug of the invention. A lug 11 on retrieving head 10 cooperates with an overshot or running tool (not shown) mounted on the end of a drill string. As will later be more fully explained, the plug is suspended on the overshot from a drill string, lowered into a well casing (not shown), and by means of rotation and longitudinal movement of the drill string is set at a desired position in the casing to form a seal.

Figure 1B:
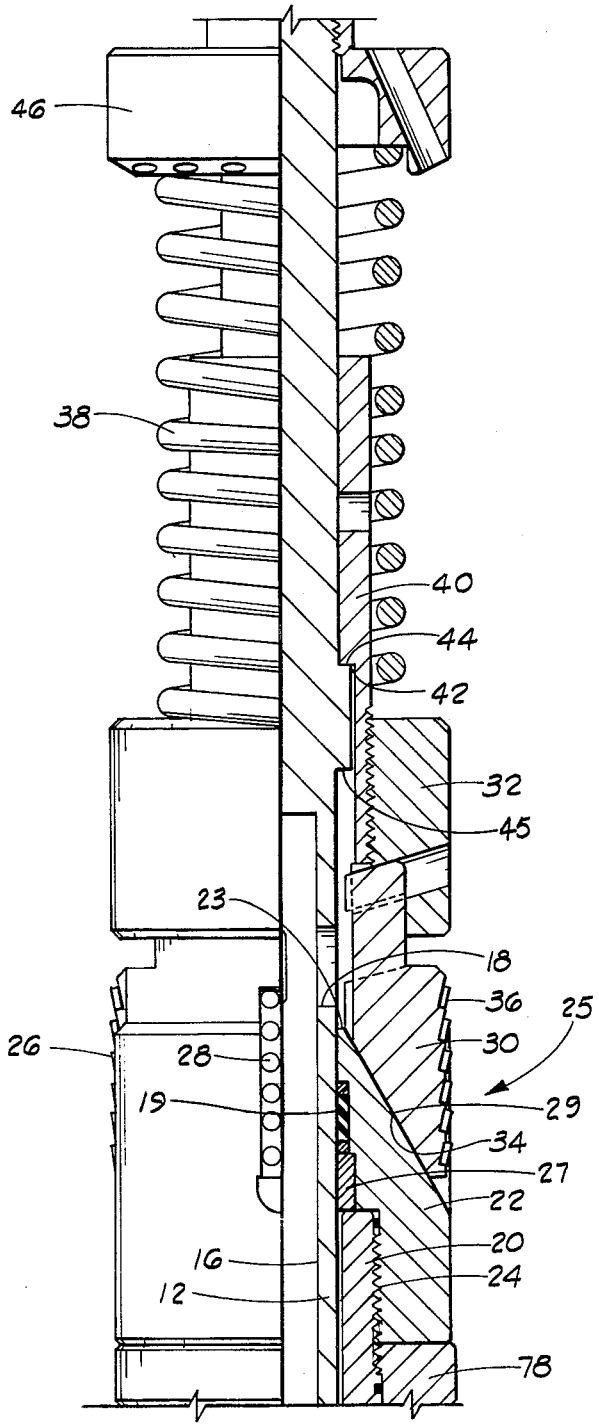

Retrieving head 10 is fixedly secured to a center mandrel 12 by means of a key 14. Center mandrel 12 extends downwardly to a mandrel cap 17 (FIG. 1*d*). The mandrel cap is attached to center mandrel 12 via a threaded connection 19 and dog 21. The dog is threaded into cap 17 and protrudes into a hole 23 in the center mandrel thus preventing relative rotation between mandrel cap 17 and center mandrel 12. A total of four dogs and holes, including dog 21 and hole 23, are positioned at 90° intervals around the circumference of the plug. The center mandrel includes a bore 16 which extends from the bottom of the plug to just above a bypass port 18 which permits fluid communication between the top and bottom of the plug as it is being moved. A plurality of ports (not visible) are formed about the circumference of center mandrel 12 opposite port 18.

Mounted over center mandrel 12 and concentric therewith is a packer mandrel 20. Mandrel 20 is cylindrically shaped and is of a size suitable to permit longitudinal motion relative to the center mandrel. Mandrel 20 is fixedly secured to a cylindrical upper slip body 22 via a threaded connection 24. The upper portion of slip body 22 includes four inclined surfaces, like surface 29, which are formed at 90° intervals about the circumference of the slip body. The uppor portion of slip body 22 includes a shoulder 23 formed about the circumference of the slip body. An undercut about the inner circumference of slip body 22 is provided, as shown, in which resides a seal 19 that is engaged about the circumference of mandrel 12 and is held in place by a spacer 27.

Indicated generally at 25 is what is referred to herein as upper anchor means. Included therein are carbide slips 26, 28, 30, such being suspended from a retainer 32. A fourth carbide slip (not visible) is suspended from retainer 32 at the rear of the plug, 180° opposite slip 28.

Slip 30 includes a flat, inclined surface 34 which is in flush contact with surface 29 of slip body 22. A plurality of carbide disks, like disk 36 are mounted on the side of the slip. Each of the other four slips are identical in structure to slip 30.

Retainer 32 is downwardly biased via spring 38. A spring centralizer 40 is generally cylindrically shaped and has a common axis with the center mandrel. The spring centralizer is threadably secured to retainer 32. Spring centralizer 40 includes des, about its circumference, a downwardly facing shoulder 42 which abuts against an upwardly facing shoulder 44 formed about the circumference of center mandrel 12. Beneath shoulder 44 on the center mandrel is a downwardly facing shoulder 45. Spring 38 is prevented from upward motion by means of a stop 46 on retrieving head 10 which is fixedly secured to the center mandrel by key 14. Thus, spring 38 is in a compressed condition between the stop and retainer 32 and is restrained from downward motion by shoulder 44.

Indicated generally at 48 (in FIG. 1*c*) are what are referred to herein as lower anchor means. Included in lower the anchor means are six carbide slips, like slip 49. The slips are equally spaced about the circumference of the plug and each includes a plurality of carbide disks. Each slip includes a surface which is in flush contact with a lower slip body 50. Like the upper slip body, the lower slip body is generally cylindrically shaped except for the plane inclined surfaces against which the slips abut.

Each of the carbide slips are attached at their lower end to a split ring collar 52 which is in turn attached, at its lower end, to a drag block assembly indicated generally at 54. Collar 52 is of conventional construction and extends about the circumference of the plug.

Included within drag block assembly 54 is a drag block 58, springs 60, and a retainer 64. A drag block sleeve 56 is generally cylindrically shaped and is mounted over packer mandrel 20 concentric therewith. Drag block 58 is spring biased outwardly from the sleeve by means of springs 60. A lip 62, formed in the sleeve, and retainer 64 limit the radially-outward range of travel of the drag block. Retainer 64 is secured to the drag block sleeve by a bolt 71. Three other drag block assemblies, like assembly 54 are similarly mounted at 90° intervals about the drag block sleeve. The radially outward surface of each drag block is formed to create a selected, relatively high level of friction between the blocks and a casing into which the plug is lowered.

Figure 2:
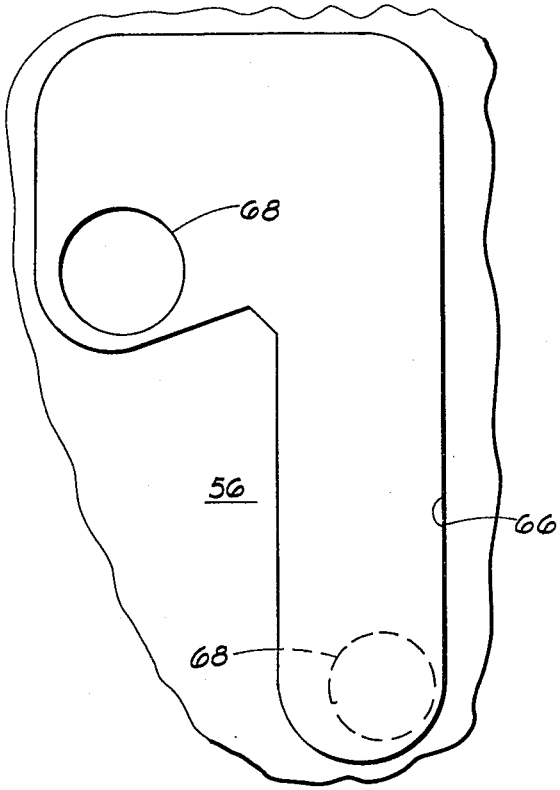
FIG. 2 is an enlarged partial planer elevation view illustrating the details of the drag block J-slot construction in the drag block sleeve.

A J-slot 66 is formed on the radially-inward surface of drag block sleeve 56. A lug 68 extends from the radially-outward side of packer mandrel 20 into the J-slot. The development of the J-slot and position of the lug is illustrated in FIG. 2.

Figure 3:
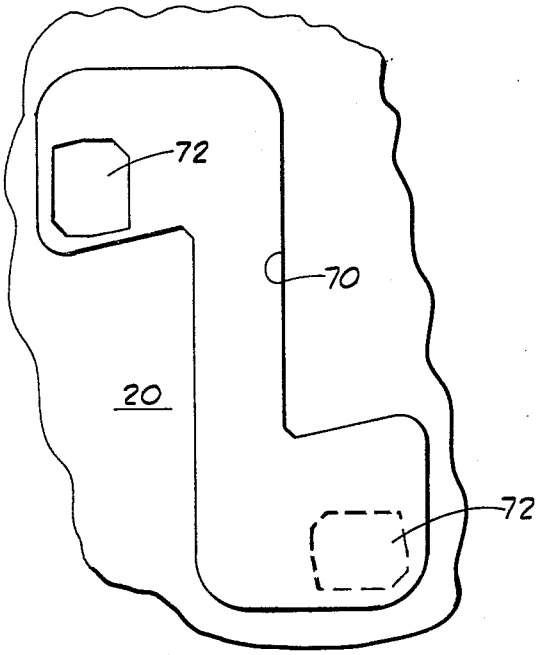
FIG. 3 is an enlarged partial planer elevation view illustrating the details of the J-slot construction in the packer mandrel.

Beneath lug 68, a second J-slot 70 is formed in packer mandrel 20. A lug 72 is mounted on the radially-outward surface of mandrel cap 17 and extends into slot 70. The development of J-slot 70 and the relationship of lug 72 thereto is illustrated in FIG. 3.

Each of the lug and J-slot combinations described above are symmetric with a second lug and J-slot combination (not visible) formed in the corresponding structure 180° opposite the above-described lugs and slots.

Figure 1C:
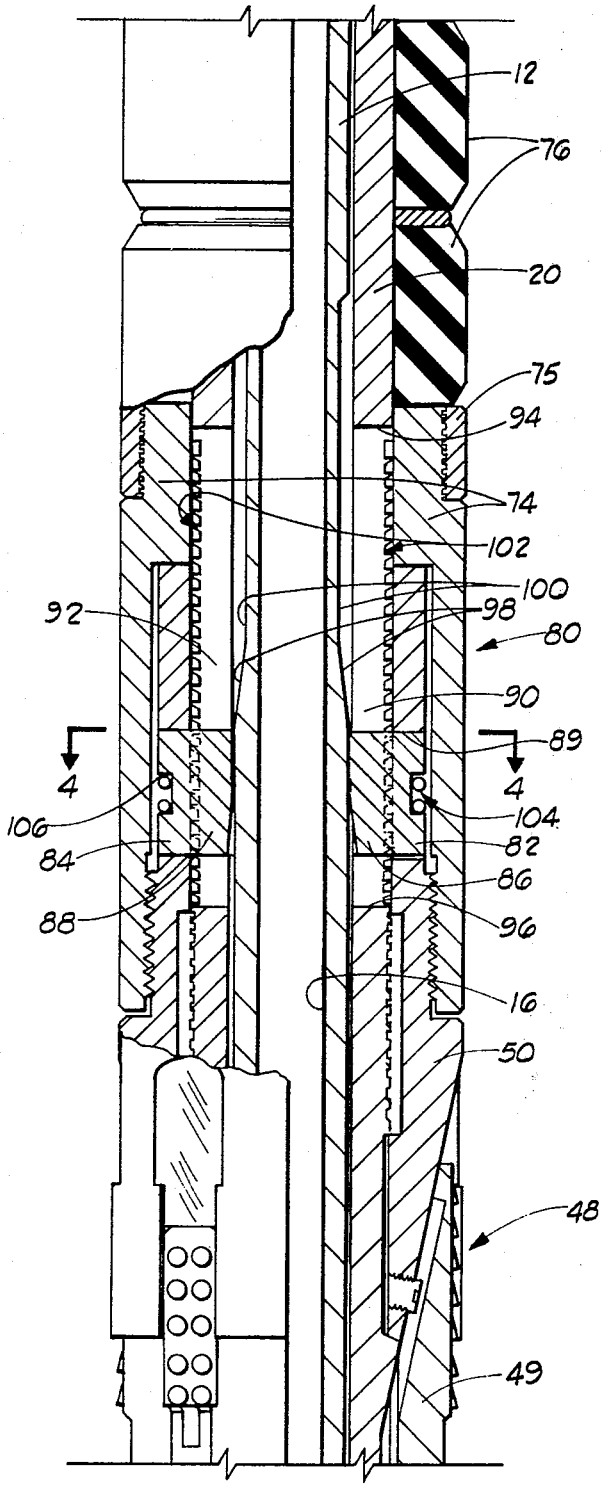
Figure 1D:
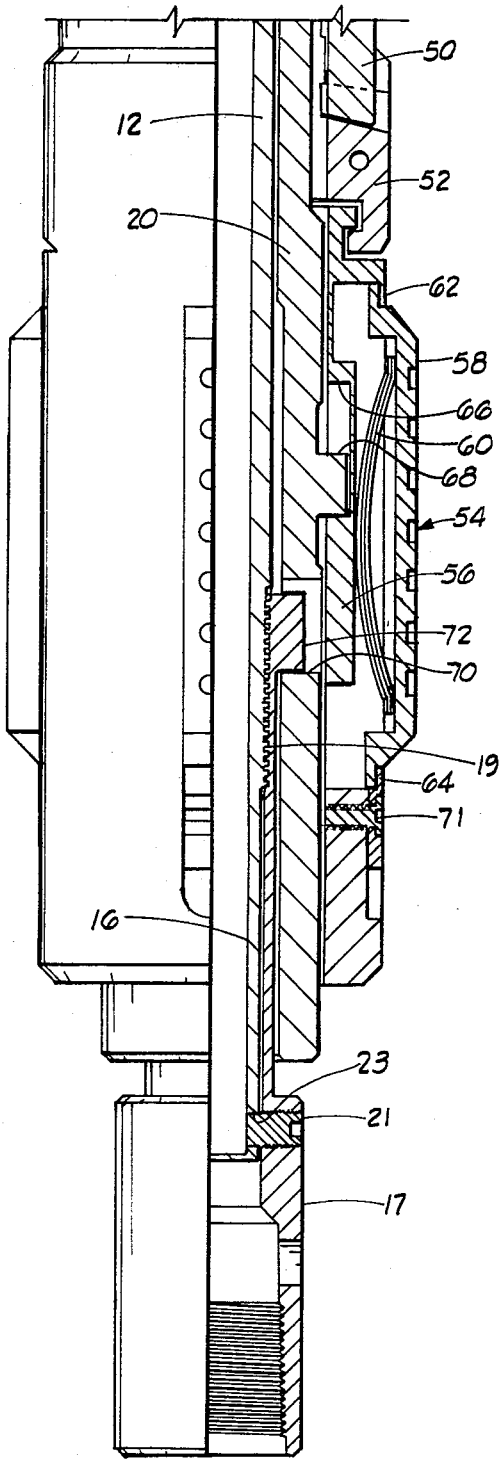

Turning now to FIG. 1*c*, lower slip body 50 is threadably secured to a ratchet cover 74. Cover 74 is substantially cylindrically shaped and is concentric with the plug axis. A cylindrical packer 76 extends about the circumference of mandrel 20 above cover 74. Packer 76 is formed from a conventional elastomeric material, and as later will be explained in the operation of the bridge plug, is compressible between cover 74 and lower shoe 75 and upper slip body 22 (acting through a disk-shaped upper shoe 78). Mandrel 20 together with upper slip body 22 and shoes 75, 78 are referred to herein as packer compression means.

Figure 4:
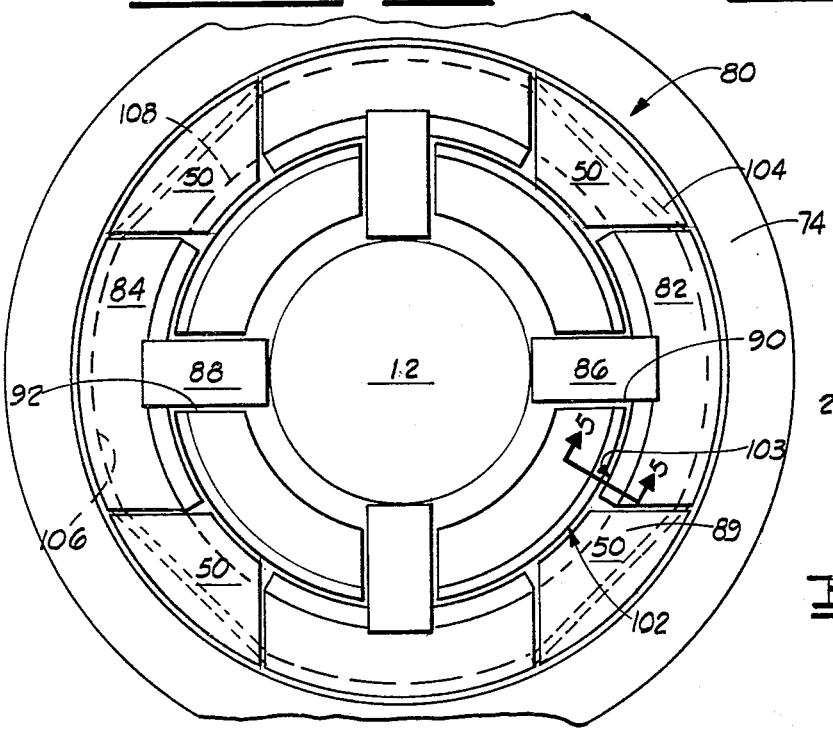
FIG. 4 is a cross-sectional view taken along line 4—4 in FIG. 1*c*.

Indicated generally at 80 in FIGS. 1*c* and 4, is packer compression locking means. Included therein are four collar segments spaced 90° apart about mandrel 20, segments 82, 84 being the only two visible in the view of FIG. 1*c*. The segments are restrained from vertical movement by four windows, one window being associated with each segment, in slip body 50. Segment 82 is substantially contained within window 89. Each segment has a tang 86, 88 which extends therefrom through a slot 90, 92, respectively, in mandrel 20. Slot 90 includes a top 94 and a bottom 96. There are two other slots in mandrel 20 in addition to slots 90, 92, each of the four slots being spaced at 90° intervals about the mandrel and each slot being substantially the same length and at the same vertical position as the others.

Center mandrel 12, against which tangs 86, 88 abut, includes a sloping shoulder 98 which joins to a narrowed or cam portion 100. Ratchets 102 (best seen in FIG. 5) are formed about the circumference of packer mandrel 20 along substantially all the length of slots 90, 92. Ratchets 103 (FIG. 5) are formed on the radially-inner side of each segment. All of the segments are radially biased inwardly by resilient bands 104 which extend about the circumference of both the collar segments and slip body 50. The bands are constrained within grooves, like groove 106 (FIG. 1*c*) in segment 84, in each of the segments.

As can be best viewed in FIG. 4, bands 104 encircle the segments (as well as the intervening portions of slip body 50). Each intervening segment of slip body 50 has a groove, like groove 108, to restrain movement of band 104 and to permit necessary radially-inward movement of the band.

OPERATION

Figure 5:
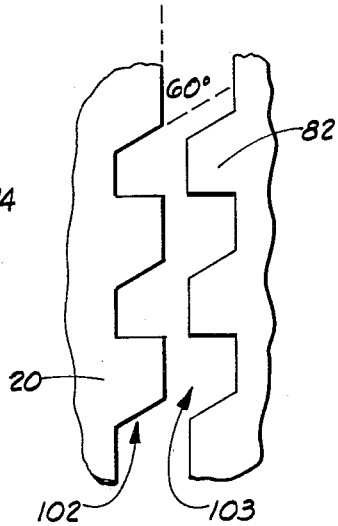
FIG. 5 is an enlarged partial cross-sectional view taken along line 5—5 in FIG. 4.

When it is desired to plug the well casing at a selected location, the bridge plug is suspended on the end of a drill string from a conventional overshot or running tool which cooperates with lug 11 on retrieving head 10. During the running-in process, the movable elements of the plug are in the positions illustrated in FIGS. 1*a*–1*d*. The upper carbide slips 26, 28, 30 (and one not visible) are in their most radially-inward position as shown. Likewise, all of the lower carbide slips are in the same (contracted) position. Ratchets 103 on each of the four collar segments, two of which being 80, 82, are in a disengaged condition with respect to ratchets 102 on mandrel 20. As can be seen in FIGS. 4 and 5, the four tangs, including tangs 86, 88, on each of the collar segments are in contact with center mandrel 12 at the position shown in FIG. 1*c* and thus maintain the collar segments radially-outwardly spaced to the point where ratchets 102, 103 are not in contact. Thus, packer mandrel 20 is free for longitudinal movement in either direction. Lugs 68, 72 on packer mandrel 20 and mandrel cap 17, respectively, are positioned in their associated J-slots as shown in FIG. 1*d* and in solid-line figures in FIGS. 2 and 3.

During the running-in process, fluid flows upwardly through center mandrel 12 in bore 16, exiting the bore through bypass port 18 and through the opposing bypass bore (not visible). When the location at which the plug is to be set is reached, the running-in process is stopped and the drill string is lifted a short distance. Since the drill string is coupled directly to center mandrel 12 via retrieving head 10, such lifting moves lugs 68, 72 upwardly in J-slots 66, 70, respectively. Drag block 58 is biased outwardly by springs 60 and is pressed against the well casing. Thus, when the lifting occurs the drag block remains stationary at least until lug 68 is moved to its uppermost position in the slot. After the short upward movement, left-hand rotation (with reference to a view directly down the casing) is applied to the drill string. Thus, each of the lugs are moved to the right (with reference to the view in FIGS. 2 and 3), in position for movement down the length of each slot.

With the continued application of left-hand rotation, the drill string is moved downwardly thus moving the lugs down the length of each slot and ultimately to the dashed-line positions illustrated in FIGS. 2 and 3. It is to be appreciated that the lugs and associated structure (not visible) located 180° about the plug from lugs 68, 72 are moving in a similar complimentary fashion. Since the drag blocks are in frictional engagement with the casing, the drag blocks remain stationary with respect to packer mandrel 20 and center mandrel 12 at least until each of the lugs is at its lowermost position in its associated slot. During downward travel of the lugs in their slots, the lower carbide slips, one of which is slip 49, are forced outwardly by virtue of the downward movement of slip body 50 with respect to the carbide slips (the carbide slips being held at their vertical location through split ring collar 52, by the above-described action of the drag blocks). As the slips move outward, the carbide disks on each slip grab the well casing and prevent further downward movement of lower body slip 50 and of body slip mandrel 74.

As the drill string continues its downward travel, center mandrel 12 likewise continues its longitudinal downward motion with respect to the anchored portion of the plug. As can be seen in FIG. 1*b*, such further downward motion moves shoulder 44 on the center mandrel downward with respect to shoulder 42 on spring centralizer 40. This action permits the compressive force in the spring to move retainer 32 downwardly thus setting carbide slips 26, 28, 30 and the fourth slip (not visible). Downward movement of the retainer causes the carbide slips to move outwardly along the inclined surfaces, like surface 29, of upper slip body 22. Such outward movement permits each of the carbide disks on the slips to bite into the well casing and thus prevents upward movement.

During the downward movement of the plug body, the bypass ports (port 18 being one) move beneath seal 19 thus preventing fluid from passing into or out of bore 16 via either port. At the same time, shoulder 45 moves downwardly and abuts shoulder 23 on slip body 22. The action of shoulder 45 against shoulder 23 moves slip body 22, upper shoe 78 and packer mandrel 20 downwardly. Since ratchet cover 74 and lower shoe 75 are anchored due to the action of the lower carbide slips, packer 76 deforms due to the action of the lower carbide slips, packer 76 deforms into sealing engagement with the casing.

Also during downward movement of center mandrel 12, narrowed portion 100 of the mandrel moves to the level of collar segments 82, 84. Since all of the collar segments are radially biased inward by virtue of bands 104, each of the segments "rides" on their associated tangs down shoulder 98 until ratchets 103 on the radially inward side of each segment engage with ratchets 102 on packer mandrel 20. In view of FIG. 5, ratchets 102, 103 move together so that their complimentary surfaces are in contact with each other. Such engagement prevents any upward movement by the mandrel since the segments are restrained from vertical movement in their respective windows in slip body 50. The ratchet action does, however, permit downward movement of packer mandrel 20 and such continues until packer 76 completely seals the casing.

At this point the plug is set and the drill string can be lifted since the leftward rotation which set the plug likewise disconnected the conventional overshot from retrieving head 10. If high pressures from either above or below the plug should cause any slippage of the upper or lower carbide slips, the seal will not break because the ratchets maintain packer mandrel 20 in a compressed condition.

When it is desired to retrieve the plug, the drill string and overshot are run in and set on to retrieving head 10. Right-hand rotation of the drill string engages the head with the overshot as well as moving lug 72 (in FIG. 3) into position for upward longitudinal movement in its J-slot. After the right-hand rotation, the drill string is moved upward, disengaging the plug as follows: center mandrel 12 again moves into the position illustrated in FIGS. 1*a*–1*d* thus forcing the collar segment tangs up shoulder 98 and disengaging ratchets 102, 103 from each other. Shoulder 44 (in FIG. 1*b*) moves upwardly, and lifts spring centralizer 40 by way of upward action against shoulder 42. When retainer 32 is lifted by such action, all of the upper carbide slips disengage and return to the position illustrated in FIG. 1*b*. The packer decompresses because shoulder 45 moves upwardly thus releasing the downward force applied to the packer via slip body 22 on shoulder 23. Packer mandrel 20 is free to move upward because of the above-described disengagement of ratchets 102, 103 caused by upward travel of center mandrel 12. Thus, after disengagement, the bridge plug resumes the positional configuration shown in FIGS 1*a*–1*d* and may be run out of the casing on the drill string.

While the invention has been particularly shown and described with reference to the foregoing preferred embodiment, it will be understood by those skilled in the art that other changes in form or detail may be made therein without departing from the spirit and scope of the invention as clarified in the appended claims.

I claim:

1. A retrievable bridge plug for plugging a well casing comprising, anwlongated body;

upper and lower anchor means mounted on said body for selectively anchoring to the casing;

an elastomeric packer mounted on said body between said anchor means;

packer compression means mounted on said body for selected relative longitudinal movement with respect to said body, said compression means being operable to deform said packer into sealing engagement with the casing;

first means for ratcheting adjacent said packer compression means;

second means for ratcheting mounted on said packer compression means, said second ratcheting means, when engaged with said first ratcheting means, maintaining said packer compression mandrel in a packer-deforming condition;

biasing means operatively connected to said ratcheting means for continuously biasing said ratcheting means into an engaged condition; and ratchet control means mounted on said body for biasing said ratcheting means into a disengaged condition responsive to longitudinal movement of said body in one direction.

2. The retrievable bridge plug of claim 1 wherein said first ratcheting means is mounted on a plurality of collar segments, said ratcheting means being formed on the radially-inner side of each segment.

3. The retrievable bridge plug of claim 2 wherein each segment is mounted in a slot in said anchor means to constrain each segment from vertical movement with respect to said anchor means.

4. The retrievable bridge plug of claim 3 wherein said ratchet control means includes, a tang extending from each segment, said tang contacting said body;

biasing means for biasing said segments radially inward to maintain such body contact; and a narowed body portion which permits radially inward movement of said segments when said portion is moved beneath said tangs.

5. The retrievable bridge plug of claim 4 wherein said packer compression means includes a mandrel having said second ratchet means formed thereabout, said mandrel being concentrically mounted on said body and having vertical slots through which said tangs extend.

6. In a retrievable bridge plug for plugging a well casing, said bridge plug of the type comprising:

a body;

a packer mandrel concentrically mounted on such a body, the packer mandrel including a plurality of horizontal grooves formed on a portion thereof and a plurality of longitudinal slots located in the grooved portion of the packer mandrel;

an elastomeric packer which is deformable to plug the casing responsive to longitudinal packer mandrel movement;

upper and lower anchor means for selectively anchoring the plug to the casing;

collar segments concentrically disposed about the packer mandrel, said segments being constrained from vertical movement with respect to said anchor means;

ratchet means mounted between said segments and the packer mandrel, said ratchet means permitting longitudinal packer mandrel movement in either direction when in a disengaged condition and restricting packer mandrel movement to movement in a packer-compressing direction when in an engaged condition, said ratchet means including a plurality of horizontal grooves formed on a portion of the radially-inward side of each segment which mate with the plurality of horizontal grooves formed on a portion of the packer mandrel; and ratchet control means mounted between said body and said segments, said ratchet control menas engaging said ratchet means responsive to longitudinal body movement in one direction and disengaging said ratchet means responsive to longitudinal movement in the other direction, said ratchet control means including:

a tang mounted on the radially inward side of each segment and extending through its associated slot;

biasing means biasing said segments radially inward; and a cam portion formed in said body, said cam portion moving said segments radially inward and outward depending upon the relative longitudinal position of the body with respect to said segments.

* * * * *

UNITED STATES PATENT AND TRADEMARK OFFICE

CERTIFICATE OF CORRECTION

PATENT NO. : 4,427,063

DATED : Jan. 24, 1984

INVENTOR(S) : Neal G. Skinner

It is certified that error appears in the above-identified patent and that said Letters Patent is hereby corrected as shown below:

In column 2, line 5, following the word "and" insert --ld--.
In column 3, line 10, the words [includes des,] and insert therefor --includes,--.
In column 4, line 38, following the word "restrain" insert the word --vertical--.
In column 5, lines 62 and 63, delete the words [due to the action of the lower carbide slips, packer 76 deforms].
In column 6, line 54, delete the word [anwlongated] and insert therefor --an elongated--.
In column 7, line 26, delete the word [narowed] and insert therefor --narrowed--.

Signed and Sealed this

*Seventeenth* Day of *April 1984*

[SEAL]

*Attest:*

GERALD J. MOSSINGHOFF

*Attesting Officer*

*Commissioner of Patents and Trademarks*